United States Patent [19]

Suggs

[11] 4,062,493

[45] Dec. 13, 1977

[54] HOME FIRE EXTINGUISHING SYSTEM

[76] Inventor: Laurine Scylester Suggs, Box 2046, Anniston, Ala. 36201

[21] Appl. No.: 695,443

[22] Filed: June 14, 1976

[51] Int. Cl.[2] ..... B65H 75/00

[52] U.S. Cl. ..... 239/197; 169/51; 242/86

[58] Field of Search ..... 137/355.16, 355.17, 137/355.26; 239/197, 195, 198; 169/51; 242/86, 86.2

[56] References Cited

U.S. PATENT DOCUMENTS

| | | | |
|---|---|---|---|
| 904,380 | 11/1908 | Vader | 137/355.26 |
| 1,520,808 | 12/1924 | Chippindale | 242/86 |
| 2,590,963 | 4/1952 | Hannay | 242/86.2 |
| 3,175,574 | 3/1965 | Morford | 137/355.26 |

FOREIGN PATENT DOCUMENTS

| | | | |
|---|---|---|---|
| 1,069,252 | 5/1967 | United Kingdom | 242/86 |

*Primary Examiner*—John J. Love

*Attorney, Agent, or Firm*—Lane, Aitken, Dunner & Ziems

[57] ABSTRACT

In a home fire extinguishing system, a garden hose is wound upon a reel mounted in a cabinet and is charged with water pressure from the house supply while wound on the reel. Water is fed to the reel through a rotary connector to a T-connector in the middle of the reel. Pipe sections extend from the side legs of the T-connector to the rotary connector and to a bearing mounted on the sidewall of the cabinet. The reel is thus rotatably mounted between the rotary connector and the bearing. Apertured round plates, which form the sides of the reel, are positioned over the pipe sections and are maintained in position on the pipe sections by means of bolts and a spacer positioned around the center leg of the T-connector.

6 Claims, 3 Drawing Figures

HOME FIRE EXTINGUISHING SYSTEM

BACKGROUND OF THE INVENTION

The present invention relates to home fire extinguisher systems, and more particularly, to a home fire extinguisher system of the hose and reel type to be permanently mounted in a convenient household location such as the kitchen.

Home fire extinguishers of the hose and reel type have been considered in the prior art. The present invention is an improvement over such prior art systems in that it is extremely simple and inexpensive and made up entirely of items which can be purchased off the shelf from a hardware or automobile parts retail outlet. The hose on the reel is continuously charged with water under pressure from the household supply so that a water stream or spray may be generated immediately from the hose at an instant's notice without having to wait for the hose to fill with water.

SUMMARY OF THE INVENTION

The system of the present invention comprises a cabinet in which a hose reel is mounted with an ordinary synthetic resin garden hose wound upon the reel. The reel comprises a T-connector, the middle leg of which is connected to the upstream end of the garden hose and the side legs of which are connected to pipe sections to provide the axle of the reel. One pipe section is closed with a cap which is supported in a bearing to permit rotation thereof. The other pipe section connects through a rotary connector to the water supply. The reel further comprises a pair of round steel plates apertured in the middle through which the pipe sections of the axle extend. The plates are maintained in place on the pipe sections by means of two bolts and a spacer formed to fit around the middle leg of the T-connector. No attachment is provided between the plates, spacer or bolts and the axle of the reel comprised of the T-connector and the pipe sections. The hose is wound around the axle and the spacer in the annular space between the plates. The end of the hose is provided with a quick-released on/off valve and is continuously charged with water so as to make it ready for immediate use. When the hose is pulled off to unwind from the reel, the pipe sections of the axle turn in the bearing and the rotary connection to permit the unwinding of the hose. Thus, a very simple, inexpensive, yet highly effective, home fire extinguishing system is provided. Because of its simplicity, it requires very little maintainance and is easily repaired. Moreover, it can be left unused with the hose charged with water for many years and will still work perfectly when needed.

DESCRIPTION OF A PREFERRED EMBODIMENT

Figure 1:
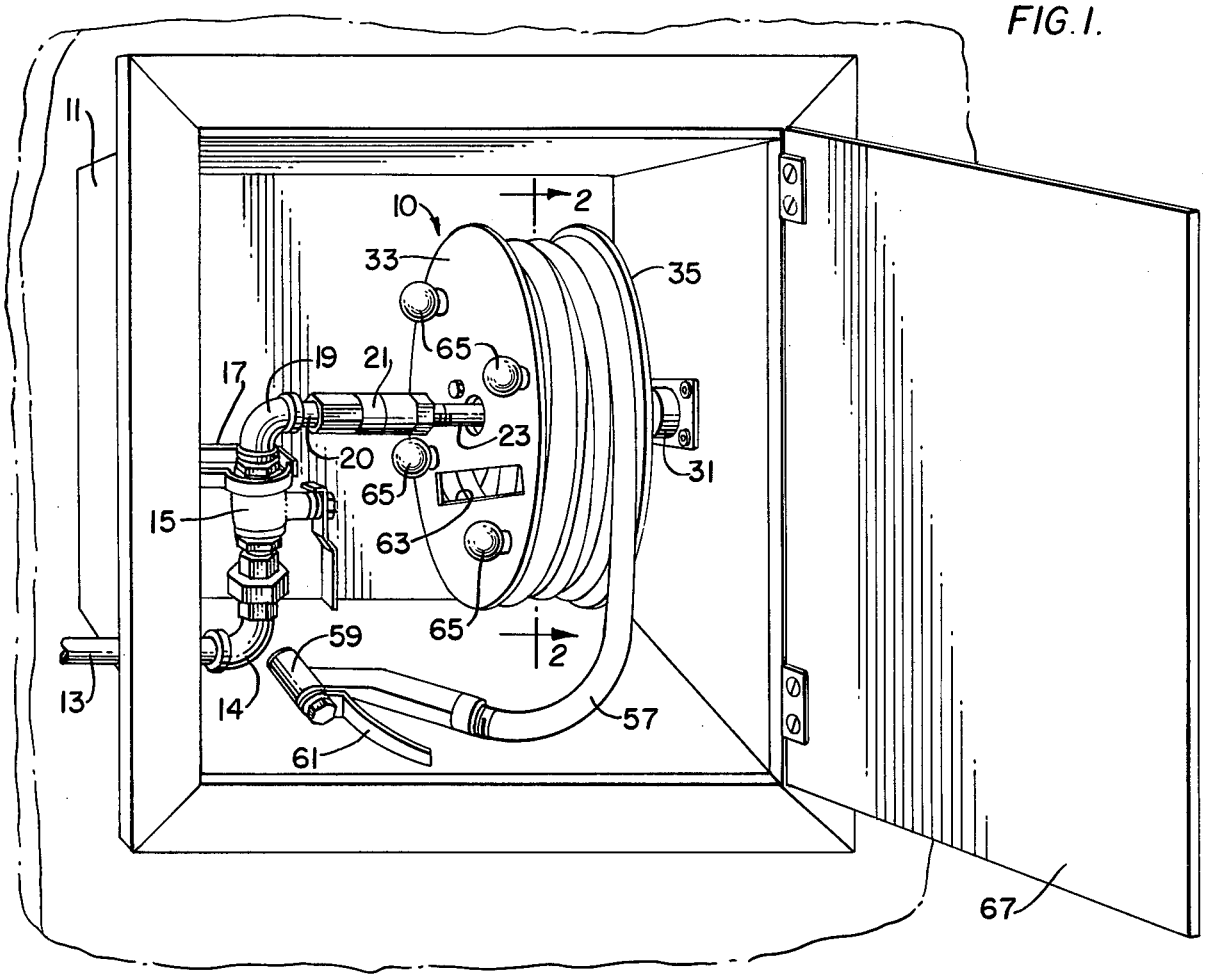
FIG. 1 is a perspective view of the fire extinguishing system of the present invention.
Figure 2:
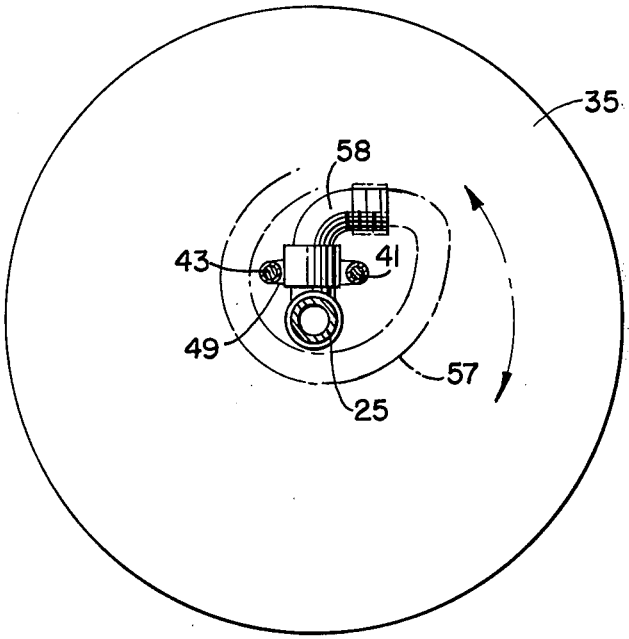
FIG. 2 is a sectional view taken through the hose reel along the lines 2—2 as shown in FIG. 1.
Figure 3:
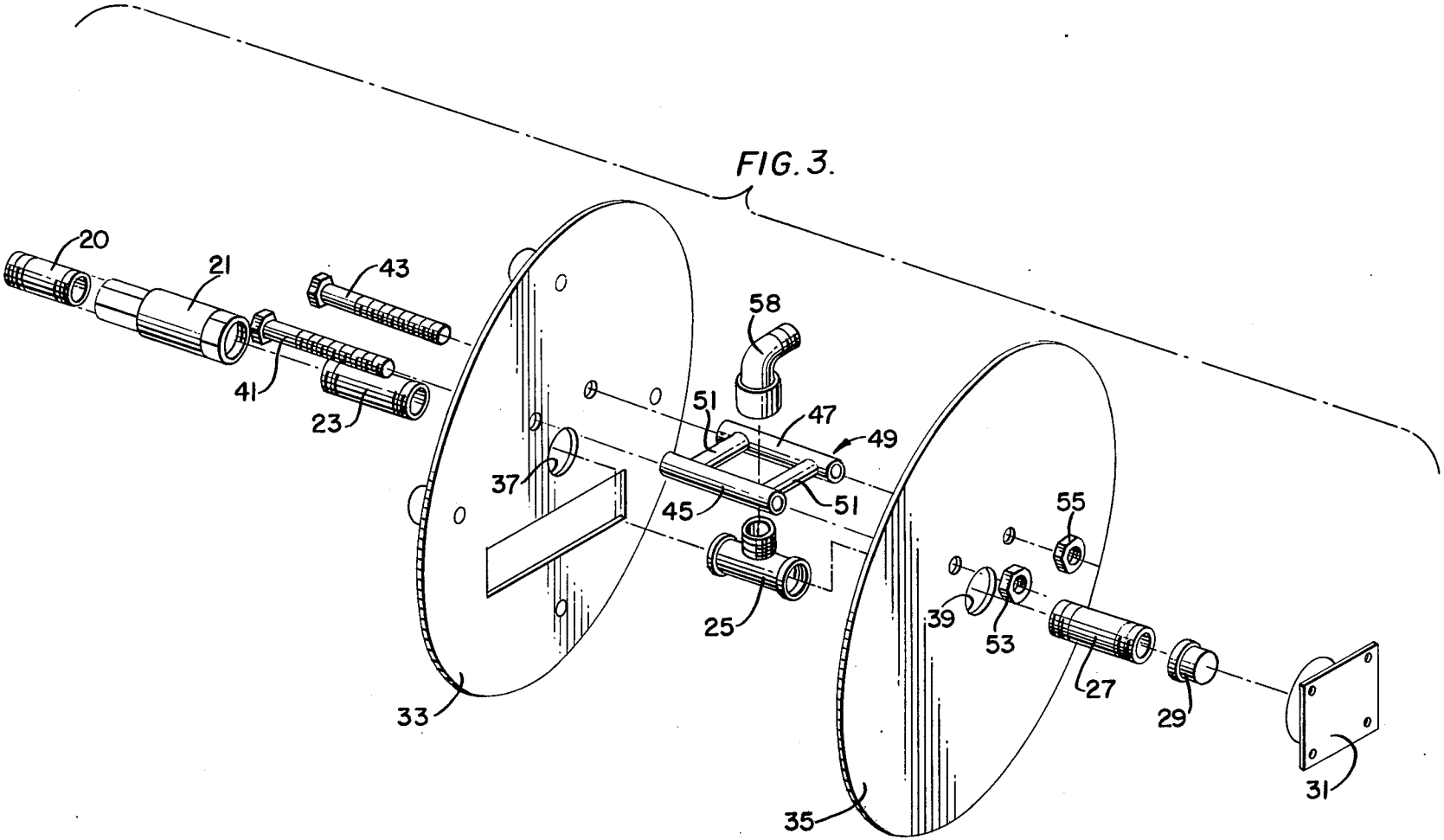
FIG. 3 is an exploded view of the reel structure shown in FIG. 1 without the hose.

As shown in FIG. 1, the fire extinguishing hose reel, designated generally by the reference number 10, is mounted in a metal cabinet 11 which, for example, may be recessed into the wall of any location in which a fire is likely to occur in the household such as in the kitchen. Water from the water supply is led into the cabinet 11 by means of the pipe 13 which connects through an elbow connection 14 to an on/off valve 15 mounted in the cabinet by means of a bracket 17. From the valve 15 the water supply is fed through an elbow connection 19 and a pipe section 20 to one side of a rotary connector 21 arranged horizontally in the middle of the cabinet 11. The left end of the rotary connector 21 to which the elbow connection attaches is fixed and the right end of the rotary connector is rotatable with respect to the left end. A short, straight water pipe section 23 threaded on each end has one end screwed into the internally threaded rotary end of the rotary connector 21 and the other end screwed into an internally threaded side leg of a T-connector 26 shown in FIGS. 2 and 3 and located in the middle of the hose reel 10. Another short section 27 of straight pipe threaded on each end is screwed into the opposite side leg of the T-connector 25 and is provided with a cap 29 screwed on the other end thereof. The cap 29 is rotatably mounted in a bearing 31, which is mounted on the side wall of cabinet 11. Thus, the assembly of the pipe 23, the T-connector 25, the pipe 27 and the cap 29 can rotate between the bearing 31 and the rotary connector 21 and comprises the axle of the reel 10. The reel 10 further comprises a pair of plates 33 and 35 which are provided with round apertures 37 and 39, respectively, in which the pipe sections 23 and 27 are positioned. The plates 33 and 35 are arranged perpendicular to the pipe sections 23 and 27. A pair of bolts 41 and 43 pass through the plates 33 and 35 in small apertures provided therefor and are positioned on either side of the middle leg of the T-connector 25 as best shown in FIG. 2. The bolts 41 and 43 pass through sleeves 45 and 47, respectively, of a spacer 49 located between the plates 33 and 35. The sleeves are arranged parallel to one another and are fixed to one another by crossbars 51. The center leg of the T-connector 25 passes up through the rectangular opening between the bars 51 and between the sleeves 45 and 47. The assembly of the plates 33 and 35, the bolts 41 and 43 and the spacer 49 are held together on the T-connector by means of nuts 53 and 55 screwed on the ends of the bolts 41 and 43, respectively, protruding through the plate 35. An ordinary synthetic resin garden hose 57, 50 to 100 feet in length, has its inner end connected to the middle leg of the T-connector 25 via an elbow connection 58 having its outer leg pointing in the direction in which the hose extends to prevent crimping the hose. The hose is wound around the spacer 49 and the axle comprised of the T-connector 25 and the pipe sections 23 and 27 in the annular space defined between the plates 33 and 35. If desired, a third bolt may be provided adjacent to the connector on the opposite side from the middle leg thereof. No attachment is provided between the assembly of the plates 33, 35, spacer 49 and the bolts 41 and 43 and the assembly of the pipes 23 and 27 and the T-connector 25 comprising the axle. The sidewalls 33 and 35 engage and merely rest upon the pipes 23 and 27 of the axle. Nevertheless, the entire reel 10 will rotate between the rotary connector 21 and the bearing 31 when the hose 57 is unwound from the reel.

A quick-released on/off-type valve 59 is provided on the outer end of the hose 57 opposite from that connected to the T-connector. The valve 59 is provided with a means for adjusting the stream issuing therefrom either into a spray or into a small diameter stream with a lot of force. The valve may be opened and closed by depressing and releasing a lever 61.

An aperture 63 is provided in the side of the plate 33 to permit access to the inside of the reel to facilitate attaching the hose to the T-connector 25. Knobs 65 are mounted on the plate 33 on the external side thereof to facilitate winding the hose on the reel. A door 67 is provided for closing the cabinet 11.

In operation, the valve 15 is normally open so that the hose 57 is continuously charged with water under pressure while the hose is wound on the reel. When it is desired to use the apparatus, the hose can be unwound from the reel simply by pulling on the end thereof with the nozzle valve 59 to pull off the length desired and then releasing a stream of water from the hose by depressing the lever 61. Water is immediately available at the time the lever is pressed without any delay because the hose has already been charged with water under pressure.

Because the system is made entirely of very simple parts, most which are available off the shelf from a hardware or automotive parts retail outlet, the device is extremely inexpensive to manufacture and yet it provides an immediately available, effective fire extinguishing system.

The above description is of a preferred embodiment of the invention and many modifications may be made thereto without departing from the spirit and scope of the invention which are defined in the claims.

I claim:

1. A fire extinguishing system comprising: a rotary connector having a fixed end and a rotary end of defining a water passage passing axially out of said rotary end; a bearing; a hose reel rotatably mounted between said rotary end of said rotary connector and said bearing, said reel comprising an axle extending between said rotary connector and said bearing, a pair of sidewalls positioned on said axle, said sidewalls defining apertures through which said axle passes, and means to maintain said sidewalls in spaced parallel relationship on said axle perpendicular thereto; said axle resting directly upon said sidewalls at said apertures and being unattached to said sidewalls and said means to maintain said sidewalls in spaced parallel relationship; said axle comprising a waterflow connector positioned between said sidewalls and a pipe section extending between said waterflow connector and said rotary connector through one of said sidewalls, said waterflow connector having a radially extending leg, said means to maintain said sidewalls in spaced parallel relation on said axle comprising a pair of rigid linear members extending between and fixed to said sidewalls and positioned adjacent to said axle and adjacent to and on opposite sides of said radially extending leg of said waterflow connector, said side wall being rotatable relative to said axle except as constrained by said rigid linear member a hose; a hose connected to said radially extending leg and wound upon said reel between said sidewalls; said axle defining a water passageway between said rotary connector and said hose; and means to supply water under pressure through said rotary connector, said pipe section, and said waterflow connector to said hose.

2. A fire extinguishing system as recited in claim 1, wherein there is no attachment between said axle and the assembly of said sidewalls and said means to maintain said sidewalls in spaced parallel relationship on said axle.

3. A fire extinguishing system comprising: a rotary connector having a fixed end and a rotary end and defining a water passage passing axially out of said rotary end; a bearing; a hose reel rotatably mounted between said rotary end of said rotary connector and said bearing, said reel comprising an axle extending between said rotary connector and said bearing, a pair of sidewalls positioned on said axle, and means to maintain said sidewalls in spaced parallel relationship on said axle perpendicular thereto; said axle comprising a waterflow connector positioned between said sidewalls and a pipe section extending between said waterflow connector and said rotary connector through one of said sidwalls, said waterflow connector having a radially extending leg, said means to maintain said sidewalls in spaced parallel relation on said axle comprising a pair of rigid linear members extending between and fixed to said sidewalls and positioned adjacent to said axle on opposite sides of said radially extending leg of said waterflow connector; a hose connected to said radially extending leg and wound upon said reel between said rotary connector and said hose; and means to supply water under pressure through said rotary connector, said pipe section, and said waterflow connector to said hose; said rigid members comprising a pair of bolts and said means to maintain said sidewalls in spaced parallel relationship on said axle further comprising a pair of sleeves, one on each of said bolts extending between said sidewalls and crossbars fixing said sleeves together extending between said sleeves on opposite sides of the radially extending leg of said waterflow connector.

4. A fire extinguishing system as recited in claim 3, wherein said waterflow connector comprises a T-connector and wherein said axle further comprises a second pipe section extending between said bearing and said T-connector and a cap closing said second pipe section.

5. A fire extinguishing system as recited in claim 3, wherein said sidewalls comprise round steel plates with apertures in the middle thereof through which said axle passes.

6. A fire extinguishing system as recited in claim 5, wherein no attachment is provided between said plates and said axle.

* * * * *

UNITED STATES PATENT OFFICE

CERTIFICATE OF CORRECTION

Patent No. 4,062,493 Dated December 13, 1977

Inventor(s) Laurine Scylester Suggs

It is certified that error appears in the above-identified patent and that said Letters Patent are hereby corrected as shown below:

Column 2, line 16, "26" should be --25--.

Claim 1, column 3, line 56, "a hose", first occurrence, should be deleted.

Signed and Sealed this

Seventh Day of March 1978

[SEAL]

Attest:

RUTH C. MASON
Attesting Officer

LUTRELLE F. PARKER
Acting Commissioner of Patents and Trademarks